United States Patent [19]

Otani

[11] Patent Number: 4,721,940

[45] Date of Patent: Jan. 26, 1988

[54] THIN TYPE VARIABLE RESISTOR

[75] Inventor: Takeshi Otani, Miyagi, Japan

[73] Assignee: Alps Electric Co., Ltd., Japan

[21] Appl. No.: 908,409

[22] Filed: Sep. 16, 1986

[30] Foreign Application Priority Data

Sep. 19, 1985 [JP] Japan ..... 60-141978[U]

[51] Int. Cl.[4] ..... H01C 10/32

[52] U.S. Cl. ..... 338/163; 338/174

[58] Field of Search ..... 338/163, 171, 174, 184, 338/164, 188, 199

[56] References Cited

U.S. PATENT DOCUMENTS 3,205,466 9/1965 Youngbeck et al. ..... 338/163

3,947,800 3/1976 Van Benthuysen et al. ..... 338/163

4,223,254 9/1980 Moffit et al. ..... 338/122

*Primary Examiner*—C. L. Albritton

*Attorney, Agent, or Firm*—Guy W. Shoup

[57] ABSTRACT

A thin type variable resistor for use with a portable radio receiver set, which is far thinner even with a knob than the prior art. The surface of a slider receiver is formed with slider mounting portions which partially rise from the upper surfaces of sliders integrally with said slider receiver. The knob is formed with a recess for fitting the slider receiver. That recess is formed with loosely fitting portions for loosely fitting said slider mounting portions.

5 Claims, 6 Drawing Figures

THIN TYPE VARIABLE RESISTOR

BACKGROUND OF THE INVENTION

1. Field of the Invention

The present invention relates to a thin type variable resistor.

2. Description of the Prior Art

In recent years, a portable radio receiver set has a tendency to be made thinner and thinner. In accordance with this tendency, a variable resistor to be incorporated into that set is required to be made thinner.

SUMMARY OF THE INVENTION

The present invention has been conceived to meet the above-specified requirement and has an object to provide a thin type variable resistor which can maintain its thinness even in case it is equipped with a knob.

In order to achieve the above-specified object, the present invention is featured by making the variable resistor thin even with a knob by forming the surface of a slider receiver with slider mounting portions which partially rise from the upper surfaces of sliders integrally with said slider receiver, by forming said knob with a recess for fitting said slider receiver, and by forming said recess with loosely fitting portions for loosely fitting said slider mounting portions.

According to a major aspect of the present invention, there is provided a thin type variable resistor comprising: a metallic mounting plate having a projection at its center; an insulating base plate mounted on said mounting plate and formed with a resistor surface on its surface; a slider receiver arranged on said insulating base plate and having sliders attached integrally thereto and contacting with said resistor circuit; a knob fitting said slider receiver; and a knob holder, wherein the improvement resides: in that said slider receiver is formed integrally with a plurality of slider mounting portions projecting partially from the upper surfaces of the sliders of said slider receiver; in that said knob is formed with a recess for fitting said slider receiver, which recess is formed with loosely fitting portions for loosely fitting said slider mounting portions; and in that the projection of said metallic mounting plate is inserted into the holes of said knob and said knob holder such that its leading end is fixed on said knob holder in such a manner to allow said knob to turn.

BRIEF DESCRIPTION OF THE DRAWINGS

Other objects, features and advantages of the present invention will become apparent from the following description taken in conjunction with the embodiment thereof with reference to the accompanying drawings, in which.

DESCRIPTION OF THE PREFERRED EMBODIMENT

Figure 1:
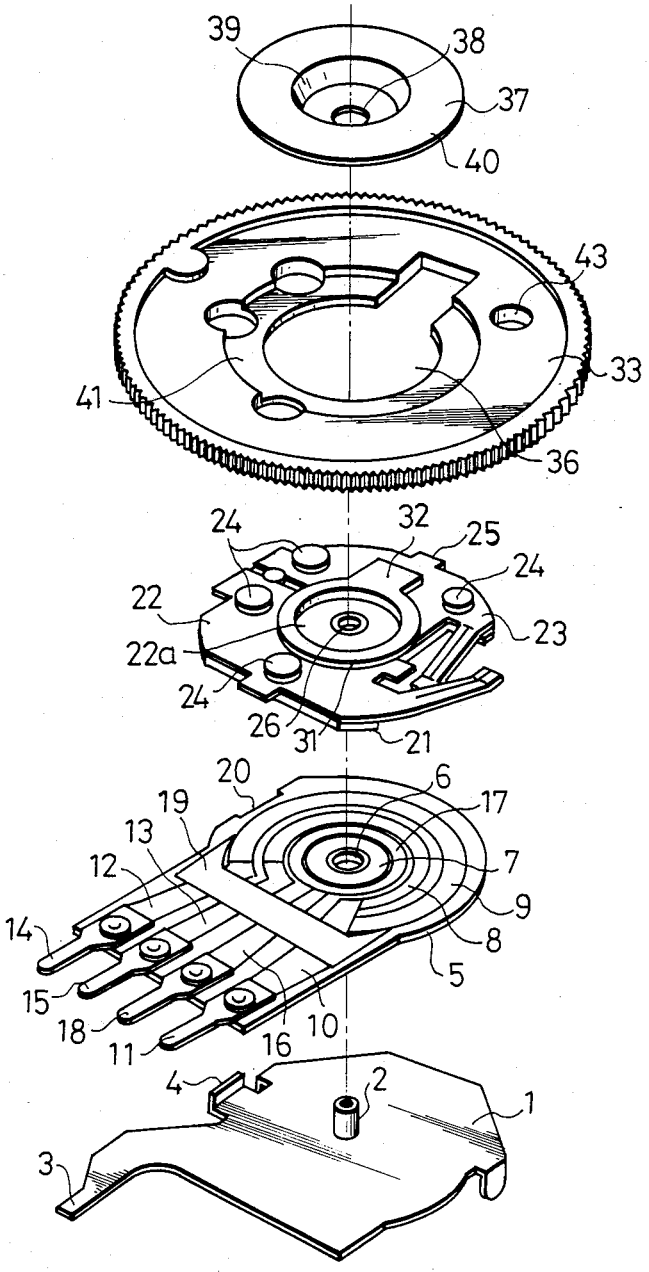
FIG. 1 is an exploded perspective view showing a thin type variable resistor according to the embodiment of the present invention.
Figure 2:
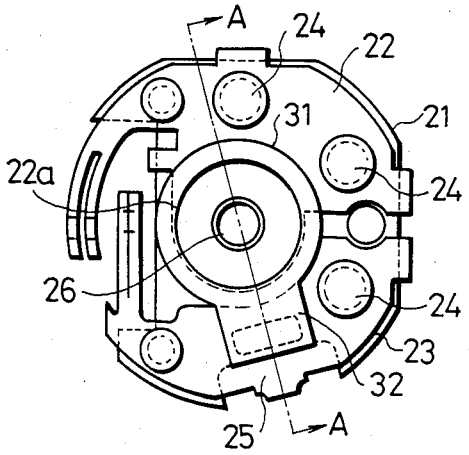
FIG. 2 is a top plan view showing a slider receiver to which sliders are attached.
Figure 3:
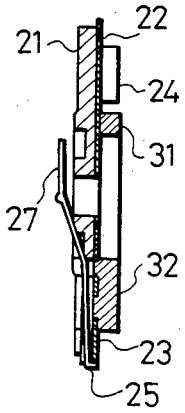
FIG. 3 is a section taken along line A—A of FIG. 2.
Figure 4:
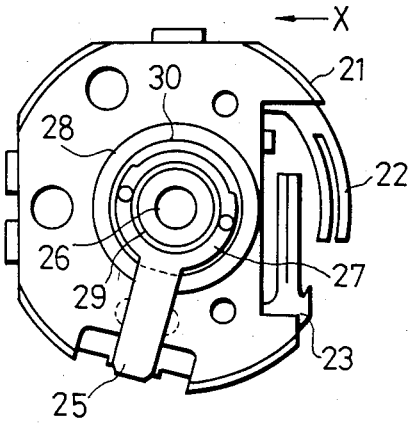
FIG. 4 is a back view of the slider receiver of FIG. 2.
Figure 5:
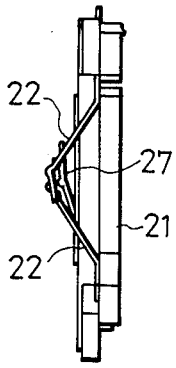
FIG. 5 is a side elevation taken in the direction X of FIG. 4.
Figure 6:
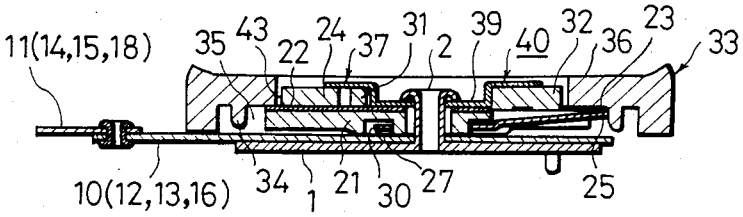
FIG. 6 is a sectional view showing the variable resistor to which a knob is attached.

Indicated generally at reference numeral 1 is a metallic mounting plate which is formed with a grommet 2 at its central portion and with a first resisting collector terminal 3 extending from the left end thereof. Indicated at numeral 4 is a bent tip for positioning a later-described insulating base plate 5. This insulating base plate 5 is formed at its center with a hole 6 into which the grommet 2 of the aforementioned mounting plate 1 can be inserted. Around the circumference edge of said hole 6, there are concentrically formed a second resisting collector pattern 7, a second resistor pattern 8 and a first resistor pattern 9, which can be insulated from the grommet 2 when the variable resistor is assembled. Moreover, the respective one-side ends of the first and second resistor patterns 9 and 8 are led out by a common conductor pattern 10 to a common 1-side terminal 11 which is revetted to the insulating base plate 5. The respective other ends of the first and second resistor patterns 9 and 8 are led out the 3-side terminal 14 and the 3-side terminal 15 thereof through conductor patterns 12 and 13. On the other hand, the second resisting collector pattern 7 is led out through a conductor pattern 16 to a second resisting collector terminal 18. Indicated at numeral 17 is an insulating coating which is applied between the collector pattern 7 and the second resistor pattern 8. Indicated at numeral 19 is an insulating coating which is applied to the individual collector patterns 10, 12, 13 and 16. Numeral 20 indicates a notch for positioning the insulating base plate 5. Numeral 21 indicates a molded slider receiver. A first resisting slider 22 and a second resisting slider 23 are attached in an mutually insulated state to the upper surface of the slider receiver 21 by means of slider mounting portions 24 which are molded integrally with the slider receiver 21. The second slider 23 is bent to the back at a portion 25, as better seen from FIGS. 3 and 4, and is formed with a fitting hole 26 for fitting the grommet 2 of the back of the mounting plate 1. The second slider 23 is formed around the peripheral edge of its fitting hole 26 with an annular portion 27, which can be fitted in a groove 30 defined by annular outer and inner walls 28 and 29 so that it can come into sliding contact with the aforementioned second resisting collector pattern 7 after the variable resistor has been assembled. Indicated at reference numeral 31 in FIG. 2 is an annular land which is formed integrally with the slider receiver 21 and concentrically with the hole 26 on the surface of the slider receiver 21. The annular land 31 is formed with a positioning projection 32 in its portion. The slider 22 is partially exposed, as at *22a*, inside of the annular land 31. Indicated at 33 in FIG. 6 is a knob which is formed at its back with a recess 35 enclosed by a partition 34 for fitting the slider receiver 21. The recess 35 is formed with both a hole 36 for fitting the positioning projection 32 and holes 43 (or loosely fitting portions) for loosely fitting the slider mounting portions 24. Indicated at numeral 37 in FIG. 1 is a knob holder which is made of a metal plate and which is formed at its center with a hole 38 for inserting the aforementioned grommet 2. The knob holder 37 is formed with a recess 39 defining the outer periphery of said hole 38. Moreover, the recess 39 can be fitted in the hole 36 of the knob 33 while a flange 40 being positioned in the recess 41 formed in the surface of the knob 33.

When the variable resistor is to be assembled, the grommet 2 of the mounting plate 1 is fitted in the hole 6 of the insulating base plate 5 while the positioning notch 20 of the insulating base plate 5 being fitted on the bent tip 4 of the mounting plate 1, and the insulating base plate 5 is placed on the upper surface of the mounting plate 1. Next, the sliding receiver 21 is placed on the insulating base plate 5 such that the grommet fitting hole 26 of the slider receiver 21 is fitted on the grommet 2. Then, the annular land 31 and the positioning projection 32 of the sliding receiver 21 are fitted in the hole 36 formed in the recess 35 of the knob 33, and the slider mounting portions 24 are loosely fitted in the holes 43 of the knob 33, thus mounting the knob 33 on the slider receiver 21. Next, the grommet 2 is inserted into the hole 38 of the knob holder 37 to fit the knob holder 37 in the recess 41 formed in the upper surface of the knob 33. Then, the leading end of the grommet 2 protruding upward from said recess 39 is caulked to complete the assemblage.

In the variable resistor thus assembled: the contact portion at the leading end of the slider 22 comes into elastic contact with the first resistor pattern 9; the contact portion at the leading end of the slider 23 comes into elastic contact with the second resistor pattern 8; the annular portion 27 at the back of the slider 23 comes into elastic contact with the second resisting collector pattern 7 lying on the insulating base plate 5; and the exposed portion **22*a* of the slider 22 inside of the annular land 31 comes into contact with the recess 39 of the knob holder 37**.

The variable resistor according to the embodiment of the present invention has the construction thus far described. When a voltage is applied between the 1-side terminal 11 and the 3-side terminal 14 of the first resistor pattern 9, the divided voltage taken by the slider 22 is led out through the knob holder 37 and the grommet 2 to the first resisting collector terminal 3 of the mounting plate 1. When a voltage is applied between the first and third terminals 11 and 15 of the second resistor pattern 8, on the other hand, the divided voltage taken by the slider 23 is led out to the second resisting collector terminal 18 through both the annular portion 27 at the leading end of the bent portion 25 of the slider 23 and the second resisting collector pattern 7 in sliding contact with the former.

According to the embodiment of the present invention, as shown in FIG. 6, the slider receiver 21 is integrated with the slider mounting portions 24 which project partially from the upper surfaces of the sliders 22 and 23, whereas the knob 33 is formed with the holes (or the loosely fitting portions) 43 for loosely fitting the aforementioned knob mounting portions 24, and the slider receiver 21 is fitted in the recess 35 of the knob 33 while its slider mounting portions 24 being fitted in the holes 43 of the recess 35 of the knob 33 and while its annular land 31 and positioning projection 32 being fitted in the hole 36. Thus, the slider receiver 21 can be fitted as a whole in the knob 33. As a result, the variable resistor assembled with the knob 33 can be made thinner than the prior art.

Moreover, the sliders 22 and 23 can be easily separated by cutting off their portions protruding from the mold after they have been molded of a common metallic material integrally with the slider receiver 21.

Since the slider receiver receiving the sliders can be attached to the knob while being fitted in the same, the present invention can enjoy an effect that the variable resistor assembled with the knob can be made thinner than the prior art.

What is claimed is:

1. A thin type variable resistor comprising:

a metallic mounting plate having a projection at its center;

an insulating base plate mounted on said mounting plate provided with a central hole through which said mounting plate projection is inserted and formed with a resistor pattern on an upper surface thereof;

a slider receiver placed rotatably on said insulating base plate provided with a central hole through which said mounting plate projection is inserted, and having sliders integrally attached thereto in contact with said resistor pattern on said upper surface of said base plate and at least one mounting portion projecting a small distance above an upper surface of said slider receiver;

a rotatable knob having a flat shape mounted on said upper surface of said slider receiver provided with a central opening and at least one hole into which said at least one mounting portion of said slider receiver is received for securing said slider receiver for rotation with said knob; and a knob holder having a flat shape mounted on said knob provided with an indented recess which fits in said central opening of said knob and a central hole through which said mounting plate projection is received for rotatably securing said knob holder to said mounting plate with said slider receiver and knob held therebetween.

2. A thin type variable resistor according to claim 1, wherein said slider receiver has an annular land formed partially with a positioning projection made engageable with a notch formed in said opening of said knob, and wherein said knob has a recess for bearing said knob holder.

3. A thin type variable resistor according to claim 1, wherein one of said sliders is formed partially with a bent portion for extending a portion of said slider to the lower side of said slider receiver to bring an annular portion into elastic contact with a collector pattern of said insulating base plate.

4. A thin type variable resistor according to claim 1, wherein said metallic mounting plate has its projection formed into a grommet and is integrated with a collector terminal.

5. A thin type variable resistor according to claim 3, further comprising: an insulating coating applied between said collector pattern and said resistor pattern formed concentrically with each other; and an insulating coating applied to terminal lead-out portions of said resistor pattern and said collector pattern, which are formed on said insulating base plate.

* * * * *